US006097274A

United States Patent [19]

Hofsäss

[11] Patent Number: 6,097,274

[45] Date of Patent: Aug. 1, 2000

[54] SWITCH HAVING A TEMPERATURE-DEPENDENT SWITCHING MEMBER AND A SUBSTANTIALLY TEMPERATURE-INDEPENDENT SPRING ELEMENT

[76] Inventor: Marcel Hofsäss, Höfener Strasse 29, Neuenbürg, Germany

[21] Appl. No.: 09/248,511

[22] Filed: Feb. 10, 1999

[30] Foreign Application Priority Data

Feb. 23, 1998 [DE] Germany ..... 198 07 288
Jul. 30, 1998 [EP] European Pat. Off. ..... 98114459

[51] Int. Cl.[7] ..... H01H 37/52; H01H 37/54; H01H 37/60

[52] U.S. Cl. ..... 337/362; 337/333; 337/365; 337/372

[58] Field of Search ..... 337/362, 388, 337/389, 397, 333, 342, 343, 365, 372, 375, 377, 380, 390, 391, 36, 52, 53, 85, 89, 100, 101, 102, 131, 135, 141

[56] References Cited

U.S. PATENT DOCUMENTS 2,139,921 12/1938 Weinhardt ..... 337/365
2,503,008 4/1950 Taylor ..... 337/343
3,443,259 5/1969 Wehl et al. ..... 337/89
3,706,952 12/1972 Alley ..... 337/348
4,319,214 3/1982 Givler .
4,363,016 12/1982 Unger ..... 337/56
4,389,630 6/1983 Ubukata et al. .
4,620,175 10/1986 Karr et al. ..... 337/343
4,636,766 1/1987 Carbone et al. .
4,843,363 6/1989 Ubukata et al. ..... 337/94
5,212,465 5/1993 Mizutani et al. ..... 337/368

*Primary Examiner*—Leo P. Picard
*Assistant Examiner*—Anatoly Vortman
*Attorney, Agent, or Firm*—Harness, Dickey & Pierce, P.L.C.

[57] ABSTRACT

A switch comprises a first and a second external terminal as well as a temperature-dependent switching mechanism that creates, as a function of its temperature, an electrically conductive connection between the two external terminals for an electrical current to be conducted through the switch. The switching mechanism comprises a switching member which changes its geometrical shape between a closed position and an open position as a function of temperature and, in its closed position, carries the current flowing through the switch. The switching mechanism further comprises a spring element which is permanently connected electrically and mechanically in series with the switching member. The displacing force of the spring element is substantially temperature-independent, the switching member having a temperature-dependent displacing force which, in its creep phase, is greater than the displacing force of the spring element.

17 Claims, 3 Drawing Sheets

SWITCH HAVING A TEMPERATURE-DEPENDENT SWITCHING MEMBER AND A SUBSTANTIALLY TEMPERATURE-INDEPENDENT SPRING ELEMENT

BACKGROUND OF THE INVENTION

1. Field of the Invention

The present invention relates to a switch having a first and at least a second external terminal as well as a temperature-dependent switching mechanism that creates, as a function of its temperature, an electrically conductive connection between the two external terminals for an electrical current to be conducted through the switch, the switching mechanism comprising a switching member which changes its geometrical shape between a closed position and an open position as a function of temperature and, in its closed position, carries the current flowing through the switch, as well as an actuating member which is permanently connected electrically and mechanically in series with the switching member.

2. Related Prior Art

A switch of this kind is known from U.S. Pat No. 4,636,766.

The known switch comprises, as the switching member, a U-shaped bimetallic element having two legs of different lengths. Attached to the long leg is a movable contact element which coacts with a switch-mounted countercontact that in turn is connected in electrically conductive fashion to one of the two external terminals.

The shorter leg of the U-shaped bimetallic element is attached to the free end of an actuating member configured as a lever arm, which at its other end is joined immovably to the housing and is connected in electrically conductive fashion to the other of the two external terminals. The actuating member is a further bimetallic element which is matched to the U-shaped bimetallic element in such a way that when temperature changes occur, the two bimetallic elements deform in opposite directions and thus maintain the contact pressure between the movable contact element and the housing-mounted countercontact.

This switch is intended as an interrupter for high currents, which cause considerable heating of the bimetallic element through which current is passing, thus ultimately lifting the movable contact element away from the fixed countercontact. Ambient temperature influences are compensated for, in this context, by the aforementioned opposite-direction deformation of the bimetallic elements.

The principal disadvantage of this design is that two bimetallic elements are required, the temperature characteristics of which must be exactly matched to one another; this is physically complex and cost-intensive to implement. In order to compensate for production tolerances, the known switch is moreover mechanically adjusted after assembly, constituting a further disadvantage.

Since the two bimetallic elements are of geometrically very different design, they also have different long-term stabilities, so that readjustment would in fact be necessary from time to time. This is, however, no longer possible during use, so that long-term stability and thus functional reliability generally leave much to be desired.

A further disadvantage of this design consists in the large overall height resulting from the U-shaped bimetallic element.

The known current-dependent switch is thus of complex design, expensive, and not very reliable.

A further current-dependent switch known from EP 0 103 792 B1 has as the switching member a bimetallic spring tongue which is attached to the one external terminal and at its free end carries a movable contact element which coacts with a countercontact that is arranged at the free end of an elongated spring element that is attached at the other end to the other external terminal. The switch is connected with its external terminals in series with an electrical device in such a way that the operating current of that switch flows through the bimetallic spring tongue. As a rule, the known switch is moreover thermally coupled to the electrical device, so that it can follow its temperature changes.

If the temperature of the device now rises above an impermissible value, the bimetallic spring tongue lifts the movable contact away from the countercontact, thus interrupting the flow of current and preventing the electrical device from heating up further. The bimetallic spring tongue can also, however, be brought into this open position by an increased flow of current, since the bimetallic spring tongue heats up due to the electrical current flowing through it. The electrical properties of the bimetallic spring tongue can be set, in coordination with the mechanical properties and the kickover temperature, in such a way that it is in its closed position, in which it conducts the operating current of the electrical device, when the ambient temperature is below the switching temperature and the operating current is also below a response current intensity. If the operating current then rises above the permissible value, the bimetallic spring tongue heats up very rapidly and reaches its kickover temperature, whereupon it transitions into its open position.

This switch thus offers protection from both overtemperature and overcurrent.

Because of the elastic mounting of the countercontact, the contact and countercontact rub against one another during switching operations, so that contaminants and deposits are rubbed off the contact surfaces, ensuring a low contact resistance and thus a good electrical connection. The elastic mounting of the countercontact furthermore ensures low mechanical loading of the bimetallic spring tongue, since the countercontact gives away to a limited extent. This prevents irreversible deformations of the bimetallic spring tongue. Since mechanical deformations of this kind can lead to a shift in the switching temperature, the overall result of this arrangement is to ensure high operating reliability.

A disadvantage with this known switch, however, is that because of the elastic deflection of the countercontact and the kickover of the bimetallic spring tongue into the open position, it requires a relatively large amount of space for the switching function of the temperature-dependent switching mechanism. A further disadvantage is the fact that during the transition from the closed position into the open position or vice-versa, the bimetallic spring tongue—like all bimetallic elements passes through a so-called "creep" phase in which the bimetallic element deforms in creeping fashion as a result of a rise or drop in temperature, but does not snap over from its, for example, convex low-temperature position directly into its concave high-temperature position. This creep phase occurs each time the temperature of the bimetallic element approaches the kickover temperature from either above or below, and leads to appreciable changes in conformation. The creep characteristics of a bimetallic element can moreover also change even further as a result, particularly, of aging or long-term operation.

During the opening movement, creep can cause the pressure of the contact against the countercontact to weaken, thus leading to undefined switching states. During the closing movement, the contact can gradually approach the countercontact during the creep phase, thus possibly creating the risk of arcing.

In a bimetallic switch known from U.S. Pat No. 4,389,630, this creep phase of the bimetallic element is suppressed by the fact that the bimetallic disk used therein is pressed down in the central region or held down at the rim, buttresses being provided which help to effect the snapover operation. In this context, the contact pressure rises continuously with increasing temperature until opening occurs.

This is achieved by the fact that the bimetallic disk is attached at the free end of a spring element, the joining point between spring element and bimetallic disk being reinforced by a housing-mounted lug. The bimetallic disk is thus placed under mechanical preload, which suppresses the creep phase.

This design is on the one hand complex, a further disadvantage consisting in the fact that the preloading of the bimetallic disk disadvantageously impairs service life and the reproducibility and long-term stability of the switching temperature. If the bimetallic disk were nevertheless to have a greater creep phase, this would impair the function of the switch.

These problems associated with the creep behavior of a bimetallic element are solved, in the case of a current-dependent switch as described in the aforementioned U.S. Pat. No. 4,636,766, in U.S. Pat. No. 4,389,630, or in EP 0 103 792, by the fact that the bimetallic spring tongue is equipped with dimples which do not suppress the creep phase completely, but do suppress it for the most part. These dimples or other actions upon the bimetallic element are complex and expensive features which moreover greatly reduce the service life of these bimetallic elements. A further disadvantage of the requisite dimple may be seen in the fact that not only different material compositions and thicknesses, but also different dimples, must be used for various performance classes and response temperatures.

On the whole, therefore, the disadvantages with these switches are not only the space requirement for the switching operation itself but principally the complex and thus expensive switching member, which moreover must be individually designed in each case for different switch types.

A further design having a movable countercontact is also shown by U.S. Pat. No. 4,319,214. The bimetallic switching mechanism comprises a co-moving countercontact mounted on a spring arm, as well as a movable contact element mounted on a bimetallic arm. The bimetallic arm either is attached directly to the lower housing part or is carried by a further bimetallic arm which in turn is attached to the lower housing part. In either case, the bimetallic arm is equipped with a dished portion for setting the defined snapover point, a counterbearing about which the corresponding bimetallic arm pivots in the event of temperature changes being associated either with the bimetallic arm or with the further bimetallic arm.

In the embodiment having the two bimetallic arms, the latter are matched to one another in terms of their switching behavior and bend about the counterbearing, if applicable, when the temperature rises, the movable contact element being moved away from the countercontact which nevertheless is readjusted due to the spring effect of the spring arm. When the switching temperature is reached, the bimetallic arm snaps over around the dished portion and, if applicable, the counterbearing, thus lifting the movable contact element away from the countercontact, which is prevented by a stop from following the contact element even farther.

These two designs are disadvantageous on the one hand because the creep phase of the bimetallic arm which is permitted only to a limited extent must be matched exactly to the spring force of the spring arm and to the physical position of the stop, so as to prevent the spring arm from reaching the stop prematurely during the creep phase, which would lead to undesired opening of the contacts before the kickover temperature is reached.

To prevent this, the bimetallic arms must be additionally equipped with dished portions limiting the creep phase, and moreover are braced approximately centeredly against a counterbearing about which they bend correspondingly.

Because of these features, the bimetallic arms are exposed to severe mechanical loads which here again have a disadvantageous effect on service life and on the reproducibility and stability of the switching temperature. Because the tolerances are permitted only within very tight limits, this switch is moreover complex and expensive.

A further disadvantage consists in the moving countercontact, which is not only complex in terms of design but here again undesirably increases the overall height because of the travel required.

A further disadvantage with the embodiment having the two bimetallic arms is that, like the generic switch mentioned at the outset, they must be exactly matched to one another in terms of their temperature characteristics in order to define the switching temperature.

In all the switches from the prior art described so far, the creep phase is thus kept as short as possible, increasing or compensating pressure as well as additional dished portions being used for the purpose.

In this connection, DE 21 21 802 C discloses a further temperature-dependent switch in which the switching mechanism comprises a spring disk which, when the switch is in the closed state, is braced with its rim on a first connection electrode and presses a centrally carried movable contact against a stationary countercontact which is provided on a second connection electrode. In the known switch, the two connection electrodes constitute an encapsulated metal housing, and are electrically insulated from one another by an insulating disk.

A bimetallic snap disk which, below its switching temperature, lies loosely in the interior of the known switch (i.e. is not exposed to any mechanical stresses) is slipped over the movable contact. In this switch, the operating current of the device being protected flows only through the spring disk; the bimetallic snap disk is not acted upon by the operating current.

With this switch, the creep phase of the bimetallic snap disk has very much less of an effect than with the switches mentioned previously, so that relatively economical switching members, which moreover have a long service life, can be used here.

When the bimetallic snap disk is heated above its switching temperature, at the end of the creep phase it suddenly jumps from its convex shape into a concave shape, and in the process braces with its rim against the cover of the housing and, with its center region, presses the movable contact away from the countercontact against the force of the spring disk, thus interrupting the circuit.

To ensure that a current cannot now flow via the bimetallic snap disk to the spring disk, an additional insulating disk is provided between the bimetallic snap disk and the cover of the housing, preventing this undesired current flow.

Although this switch is extremely reliable in technical terms and has had great economic success, it is still of too complex a design for certain applications. For example, a specially matched spring disk must always be used as a function of the switching temperature, convexity, and thickness of the bimetallic snap disk; this is altogether complex and expensive. A further disadvantage may be seen in the additional insulation between the bimetallic snap disk and the cover of the switch.

A further disadvantage for certain applications lies in the fact that this switch is not current-dependent, since the bimetallic snap disk does not at any point carry the operating current. It is now commonly known, however, to equip the switch with a series resistor through which the operating current flows and which, if the current flow is too high, heats up correspondingly and causes the bimetallic snap disk to kick over. These design variants are also technically very reliable, but as compared with the switches mentioned at the outset they have the disadvantage that the series resistor cannot react as quickly and sensitively as the bimetallic element of the switch, through which the current flows.

SUMMARY OF THE INVENTION

In view of the above, it is an object of the present invention to improve a current-dependent switch of the kind mentioned in the outset such that excellent operating reliability and long service life are achieved with an economical and simple design.

In the case of the switch mentioned at the outset, this object is achieved, according to the present invention, in that the switching member comprises a spring element whose elastic or displacing force is substantially temperature-independent; and the switching member has a temperature-dependent elastic displacing force which, in its creep phase, is greater than the displacing force of the spring element.

The object underlying the invention is completely achieved in this fashion. This is because the inventor of the present application has recognized that the mechanically and electrically parallel arrangement, known from DE 21 21 802 C, of the temperature-neutral spring element and the switching member can be modified into an electrical and mechanical series circuit and can be used in the generic switch in order to combine a number of advantages in the new switch thus created.

Arranging the spring element and switching member electrically in series results in a current-dependent switch, since the switching member, which preferably is a bimetallic element or a trimetallic element, can heat up very rapidly because of its low thermal mass in the event of excessive current flow or even brief current spikes. Because of the mechanical series arrangement, i.e. the fact that the spring force of the spring element coacts with that of the switching member, the creep phase of the switching member can moreover be compensated for. When the geometry of the switching member changes during the creep phase, this effect on contact-pressure is immediately compensated for by the spring element. It is thus possible for the first time to make possible a long creep phase for the switching member even in a so-called current-dependent switch, since the spring element can compensate for the "undesired" geometrical changes during the creep phase. This means, however, that a more easily produced and thus more economical switching member can be used, which moreover has a greater service life, since the dimple can be dispensed with and a greater hysteresis is permissible, so that the creep phase can be maximally utilized.

The result is to place not only lesser geometrical requirements on the switching member, but also lesser demands on the spring element, since the latter must now merely ensure that the switching member remains below its kickover temperature (i.e. during the creep phase) in electrical contact with a countercontact at one of the external terminals. Switch designs which differ in terms of performance class and response temperature can now be designed with substantially the same spring element but different switching members; as already mentioned, the geometrical and mechanical conditions for these components of the switching mechanism are much less stringent, so that they are altogether easier and more economical to produce.

The advantages resulting here in terms of the service life of the switching member are the same as those with the bimetallic snap disk that is laid in loose as disclosed by DE 21 21 802, although excellent current sensitivity is achieved. With the new switch, greater emphasis in general can be placed on electrical properties and switching temperature; with the new switch, for the first time in the art, the mechanical spring force of the switching member plays a subordinate role, since it needs to be only so great that the switching member is not excessively compressed by the spring element. The switching operation itself is caused, after the completion of the creep phase, by the switching member alone, which is now always preloaded in its closed position. This preloaded switching member has a number of further advantages: for example, it does not vibrate in a magnetic field and presents no risk of arcing, since the preload prevents contacts from opening or closing gradually.

Only a very small dimple in the bimetallic element is therefore now required, which simply has to guarantee the snap effect for abrupt contact separation. A larger dimple, as used hitherto to enhance or suppress the creep phase, is no longer necessary. Mechanical stresses are thus reduced, and the service life and the reliability and reproducibility of the switching point are greatly increased.

The temperature-neutral spring element no longer exerts on the bimetallic element any pressure which inhibits its deformation; instead, in the creep phase, it compensates for the deformation of the bimetallic element by its own deformation, in such a way that the movable contact element and fixed countercontact remain securely in contact with one another so as to ensure a low contact resistance; below the switching temperature, the contact pressure remains constant, largely independent of temperature.

The creep phase of the bimetallic element is thus no longer suppressed as in the existing art, but rather, so to speak, compensated for, the reason being that in the creep phase, the bimetallic element can deform in almost unimpeded fashion, changes in the geometry being compensated for by the spring element in such a way that the switch remains securely closed.

For this purpose, the temperature-dependent displacing force of the bimetallic element is selected so that in the creep phase it is greater than the largely temperature-independent displacing force of the spring element, which thus merely "guides" the accordingly "rigid" bimetallic element.

One great advantage of the new switch lies in its simple design: all that is needed besides the housing-mounted countercontact is a bimetallic element, while the spring element is temperature-neutral and thus economical. Overall, the bimetallic element and spring element do still need to be matched to one another in terms of displacing force, but no longer additionally matched in terms of their temperature characteristics, since the switching mechanism adjusts itself, so to speak. A standard spring element for all temperature ranges is thus possible, yielding a substantial streamlining effect. This design moreover makes it possible to achieve a low overall height; a new individual adjustment is not required for different switching temperature, and the bimetallic element simply needs to be designed with the same spring characteristics but different switching temperatures.

A further advantage consists in the fact that tolerances and fluctuations in the switching temperature are compensated for by way of the guidance by the temperature-neutral spring element.

In an embodiment, it is preferred if the spring element is joined at its first end to the first connection element and at sits second end to the switching member; in its closed position the switching member is preferably pressed with its free end, by the spring element, against a countercontact joined to the second connection element, and in its open position its free end lifts away from the countercontact, which in further preferable fashion is fixed immovable to the switch; also preferably, the switching member carries at its free end a movable contact element which coacts with the countercontact.

These features, individually and in combination, first of all make available a very simple physical design for the new switch. The permanent join between the switching member and spring element eliminates the disadvantages associated with placement of the loose bimetallic snap disk. A further advantage consists in the fact that no additional insulation is needed; when the contact element has lifted off from the countercontact, there is no risk of an unintended current path. A further advantage is the fact that in its open position, the switching member is not exposed to any mechanical stresses, which increases the long-term stability of the new switch. The result, however, is also that no bracing of the switching member against the cover, etc.—by way of, for example, support nipples—is necessary, thus making possible a planar cover and/or base, which was not the case with existing switches.

It is further preferred if the switching member and spring element are welded to one another or joined permanently to one another by crimping, the free end of the switching member and the first end of the spring element preferably lying on the same side of the join between spring element and switching member.

This feature is advantageous in terms of design because during assembly, the switching member and spring element simply need to be placed on top of one another and then joined permanently to one another at one end by welding or crimping, before the spring element is then joined to the first external terminal. Altogether, therefore, only two automatable steps are necessary for final assembly of the new switch, once the individual components have been produced and delivered. This leads in general to a very economical switch, since complex assembly steps are eliminated.

A further overall advantage of this design consists in the small space requirements: on the one hand, the "folded-over" arrangement of the countercontact with respect to the join between switching member and spring element requires smaller dimensions in the longitudinal direction. But small dimensions are also required transversely to the longitudinal direction, i.e. in the "switching direction." During the creep phase, the switching member tends to lift the movable contact element away from the countercontact, which is compensated for by a lowering of the joining point between spring element and switching member. When the switching member then snaps over, the joining point moves even farther in the direction of the countercontact, while simultaneously the movable contact is moved in the opposite direction. The distance between the attachment point of the spring element on the first external terminal and the countercontact is thus doubly utilized, so to speak, first for the compensation movement of the joining point between switching member and spring element during the creep phase of the switching member, and then to lift the movable contact element away from the countercontact.

The overall result of this design is a switch having a very low height and altogether requiring very little material, which in turn contributes to an economical switch.

It is further preferred if the first external terminal is joined to a connection electrode to which the spring element is attached with its first end; and if the second external terminal is preferably joined to a second connection electrode and the switching mechanism is arranged between the first and the second connection electrode.

This feature results in a very simple design, the reason being that only two connection electrodes, to be arranged parallel to one another, need to be provided, between which the switching mechanism is arranged by the fact that the spring element is attached with its first end to the one connection electrode, while the countercontact is provided on the other connection electrode.

It is of overall advantage in this context if the switching member, spring element, and both connection electrodes are stamped out from strip material.

These features are advantageous with regard to belt-based production, since these four basic components of the new switch can be delivered, for example, via four different belts and automatically joined to one another in the manner described above so as to create the new switch. One great advantage in this context is that neither the switching member nor the spring element needs to be delivered as bulk material, which always entails considerable problems with known switches since the bulk material must be separated out and aligned prior to assembly. These problems of course no longer occur when the individual constituents are stamped out from continuous strips. This makes possible complete belt-based production without additional assembly, since any desired connection technology can be implemented on the connection electrodes, for example crimp terminals, plug terminals, solder terminals, etc. This kind of application freedom in the production of a temperature-dependent switch was not hitherto known.

It is preferred in this context if the first and second connection electrodes are held by an insulating support, the second connection electrode preferably being an integral part, by injection-embedding, of an insulating lower housing part which is closed off by the first connection electrode.

This feature is also of great advantage in terms of design, since the four basic constituents of the new switch, namely the switching member, spring element, and the two connection electrodes, can be assembled into both a so-called open and a closed switch with no need to modify the design of the four constituents themselves.

A further advantage with the new switch is the fact that the cover part constituted by the first connection electrode, and the base part constituted by the second connection electrode, can be flat, planar electrodes, which hitherto was not possible in the prior art. Not only does this result in a very low overall height for the new switch, but these planar surfaces moreover create a precondition for substrate printing, in order to allow the implementation of series or parallel resistors with which further functions can be imparted to the new switch.

Further advantages are evident from the description and the appended drawings.

It is understood that the features mentioned above and those yet to be explained below can be used not only in the respective combinations indicated, but also in other combinations or in isolation, without leaving the context of the present invention. dr

BRIEF DESCRIPTION OF THE DRAWINGS

An embodiment of the invention is depicted in the drawings and will be explained in more detail in the description below. In the drawings.

DETAILED DESCRIPTION OF PREFERRED EMBODIMENTS

Figure 1:
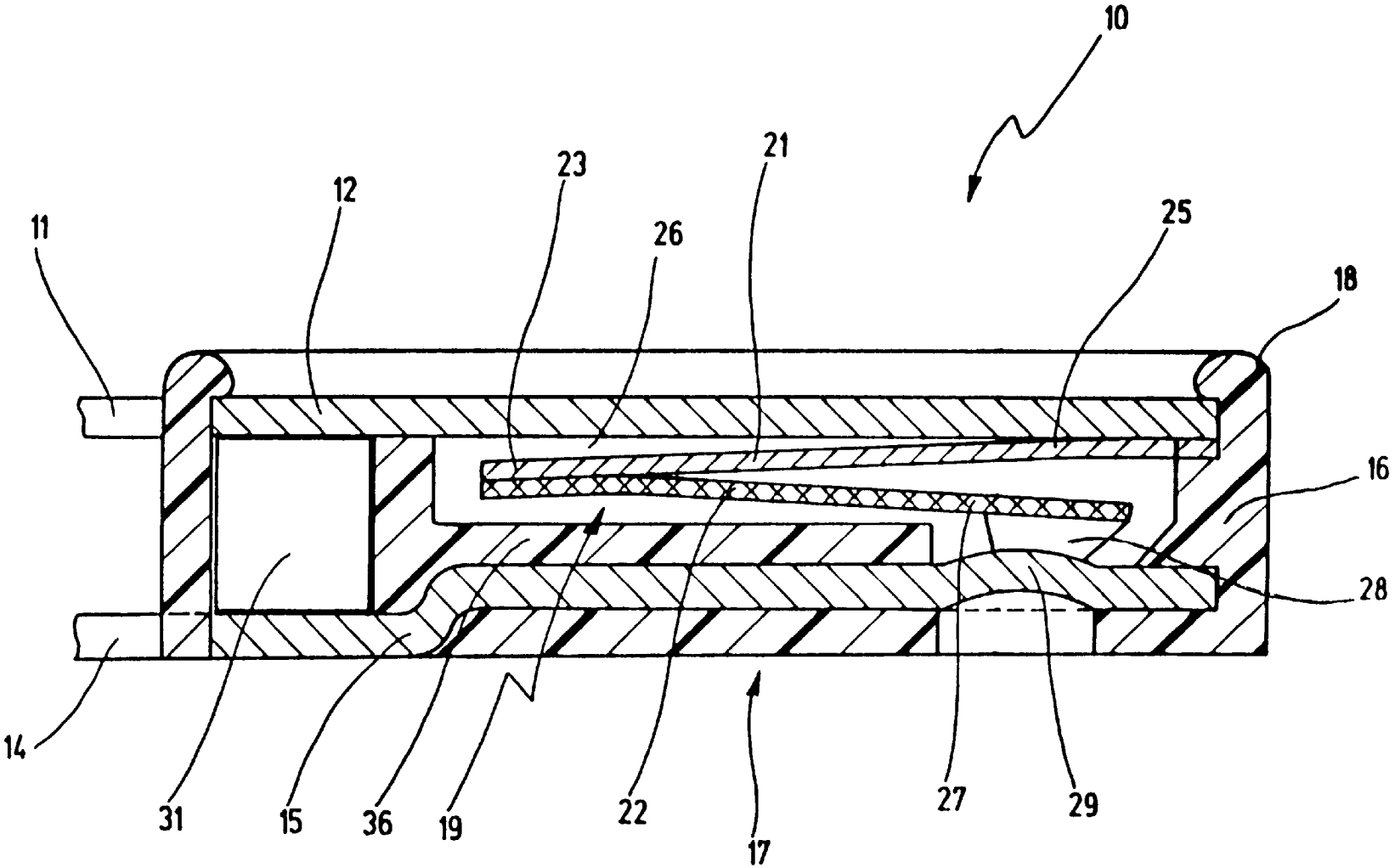
FIG. 1 shows a longitudinal section through the new switch.

In FIG. 1, 10 generally designates a new switch which is depicted in schematic longitudinal section.

The new switch 10 has a first external terminal 11 which is joined integrally to a flat connection electrode 12. Also provided is a second external terminal 14 which is configured integrally with a second connection electrode 15. The two connection electrodes 12, 15 are held on an insulating support 16 which holds the two connection electrodes 12, 15 spaced apart parallel to one another.

While insulating support 16 can theoretically be open laterally, FIG. 1 shows an embodiment in which insulating support 16 comprises a cup-shaped lower housing part 17 which is configured around second connection electrode 15, by injection-embedding or encapsulation, in such a way that second connection electrode 15 is an integral part of lower housing part 17. Lower housing part 17 is closed off by first connection electrode 12, which for this purpose acts as cover part and is held in lossproof fashion by a hot-welded rim, indicated at 18, of insulating support 16.

Arranged between the two connection electrodes 12, 15 is a temperature-dependent switching mechanism 19 which comprises a mechanical and electrical series circuit made up of a spring element 21 and a switching member 22, which are joined to one another by a join indicated at 23. In the present case, switching member 22 is a bimetallic element.

Spring element 21 has a largely temperature-independent elastic or displacing force, which in the context of the present invention means that the displacing force or spring force of spring element 21 does not change appreciably within the permissible operating temperature range of switch 10. The displacing force of the bimetallic element, on the other hand, is highly temperature-dependent, and even in the so-called creep phase is already sufficient that spring element 21 cannot exert on the bimetallic element any pressure that impedes the deformation of the bimetallic element, which in this spring system is thus rigid at constant temperature.

Spring element 21 is attached with its first end 25 to first connection electrode 12 on the right in FIG. 1, and with its second end 26 leads into join 23 with switching member 22. Switching member 22 carries at its free end 27 a movable contact element 28 that coacts with a switch-mounted countercontact 29 that is configured on second connection electrode 15.

Also provided between the first and second connection electrodes 12, 15 is a PTC element, indicated at 31, which is arranged electrically in parallel with switching mechanism 19.

In its closed position shown in FIG. 1, switching mechanism 19 creates an electrically conductive connection between the two external terminals 11, 14, thereby short-circuiting PTC element 31. A current flowing through switch 10 passes from first external terminal 11 into first connection electrode 12 and from there via spring element 21 into switching member 22, from which it emerges via movable contact element 28 and then passes via countercontact 29 and second connection electrode 15 to second external terminal 14. If there is then an increase either in the temperature of switch 10 or switching member 22, and/or in the current flowing through switching member 22, switching member 22 moves into its open position (yet to be described) in which it lifts movable contact element 28 away from countercontact 29. The current flow through switching mechanism 19 is thereby interrupted, so that a residual current can now flow through PTC element 31. This residual current heats up PTC element 21 to the point that the temperature in switch 10 remains above the response temperature of switching member 22. In other words, PTC element 31 provides self-holding for switch 10 once it has opened.

Figure 2:
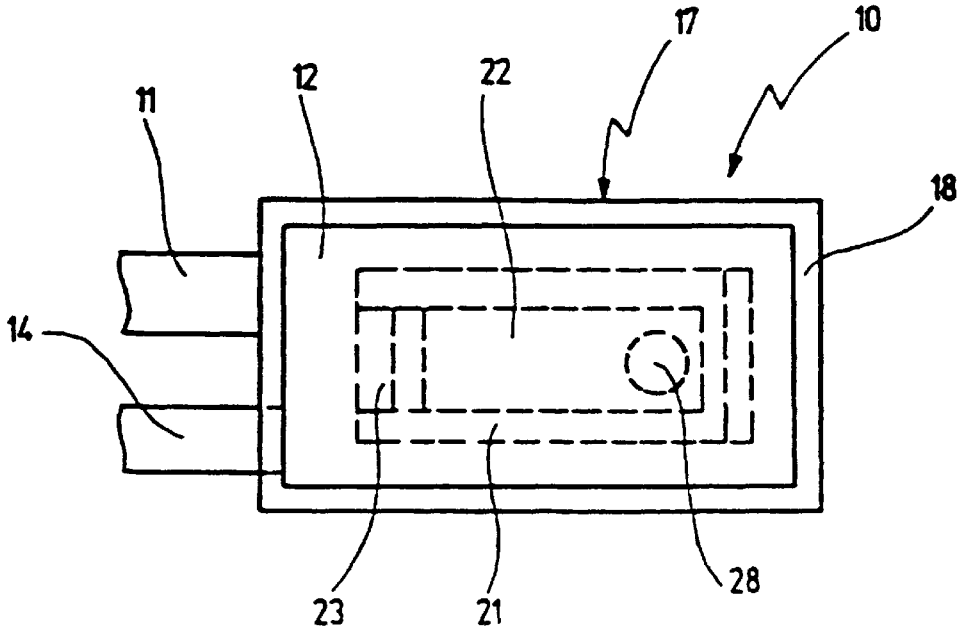
FIG. 2 shows a plan view of the switch according to FIG. 1.

FIG. 2 shows a plan view of the switch of FIG. 1, the first and second external terminals 11, 14 here being indicated not one below another as in FIG. 1, but next to one another. It is evident from FIG. 2 that rim 18 of lower housing part 17 completely surrounds first connection electrode 12, so that switch 10 is completely encapsulated.

It is further evident from FIG. 2 that both spring element 21 and switching member 22 are configured as elongated tongues which, in the plan view, are arranged one below another in such a way that both first end 25 of spring element 21 and free end 27 of switching member 22 are located next to join 23 to the right in FIG. 2.

Figure 3:
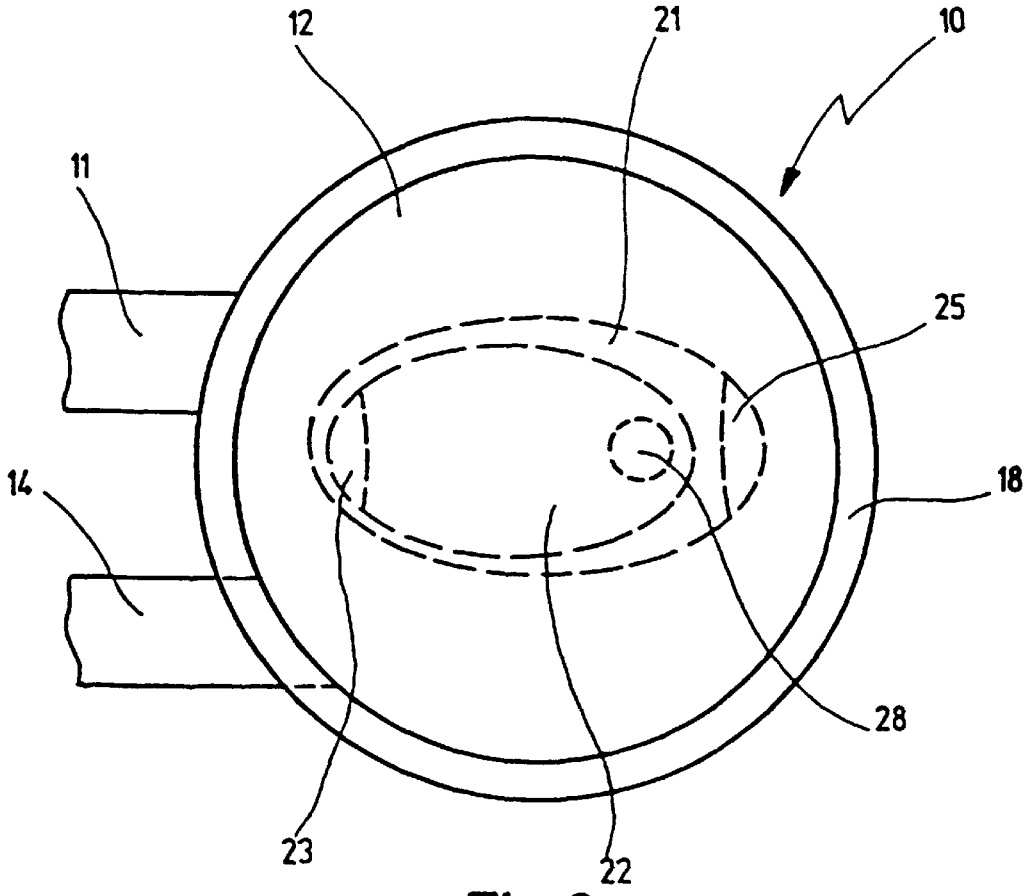
FIG. 3 shows a second embodiment of the new switch, in a view like that of FIG. 2.

FIG. 3 shows a further switch 10 which has a rounded plan rather than the rectangular plan of FIG. 2. Otherwise, however, switch 10 of FIG. 3 corresponds to the configuration as shown in longitudinal section in FIG. 1, identical features being designated with the same reference numeral. It should be mentioned that spring element 21 and switching member 22 are each configured as oval disks.

Leaving aside PTC element 31, which of course can be omitted whenever a self-hold function is not desired, the new switch 10 comprises four basic constituents, namely the two electrodes 12, 15 as well as spring element 21 and switching member 22. All four components can be stamped out from strip material and brought together for the purpose of automatic assembly. For this, join 23 is first produced by welding (FIG. 1) or crimping (FIGS. 4 through 6), whereupon spring element 21 is then welded at its first end 25 onto connection electrode 12. Because of the V-shaped configuration of the switching mechanism, free end 27 of switching member 22 thus ends up located above countercontact 29. It should also be mentioned here that movable contact part 28 can of course be dispensed with, but that contact part 28 provides for better contact resistance with respect to countercontact 29.

The two connection electrodes 12, 15 are then also attached to insulating support 16; it is possible to injection-mold lower housing part 17 around connection electrode 15 and then set connection electrode 12, with switching mechanism 19 attached thereto, in place from above, and attach it by way of a rim 18 that is hot-pressed.

Figure 4:
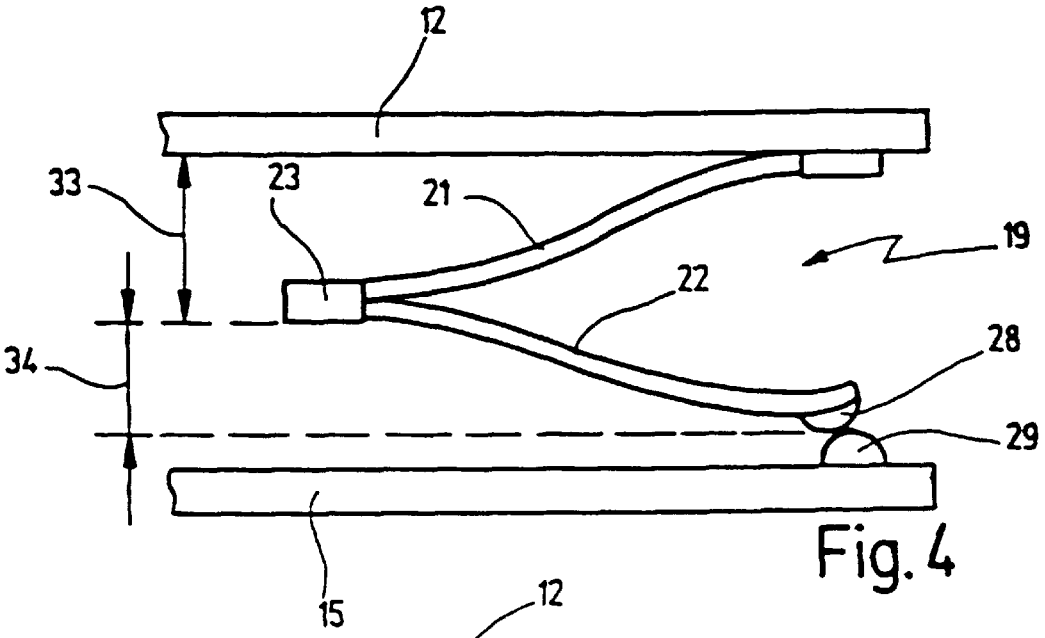
FIG. 4 shows the switching mechanism of the switch of FIG. 1 in a schematized, enlarged depiction, the switching member being in the closed position.

FIG. 4 schematically shows switching mechanism 19 of FIG. 1 at enlarged scale, in its closed position. Switching member 22 is so far below its kickover temperature that its creep phase has not yet begun. Switching member 22 presses join 23 upward in FIG. 4 against the force of spring element 21, thus resulting in a distance from first electrode 12 indicated at 33, and a distance from countercontact 29 indicated at 34.

Figure 5:
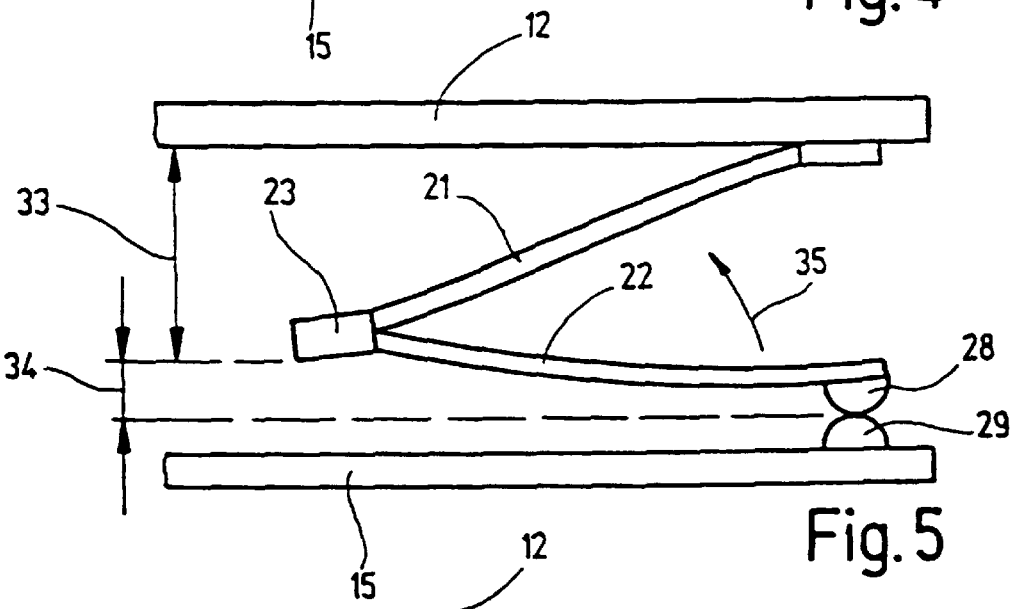
FIG. 5 shows a depiction like that of FIG. 4, but during the creep phase of the switching member.

If the temperature of switching member 22 then rises as a consequence of an increased current flow or an increased outside temperature, the creep phase of switching member 22 first begins, in which its spring force working against the force of spring element 21 weakens, so that join 23 is moved downward in FIG. 4, as depicted in FIG. 5. The displacing force of the bimetallic element is still so great, however, that the displacing force of spring element 21 is not sufficient to prevent the deformations which occur in the creep phase. Irrespective of its geometrical changes in the creep phase, the switching member may be regarded as rigid by comparison with spring element 21: and the contact pressure is exerted solely by the displacing force of the spring element.

Distance 33 becomes greater as distance 34 becomes less. The mechanical series circuit made up of spring element 21 and switching member 22, however, continues to press movable contact element 28 against countercontact 29. A comparison between FIGS. 4 and 5 reveals, however, that in FIG. 5, movable contact element 28 has shifted transversely with respect to countercontact 29. This friction is desirable, since the contact surfaces between contact element 28 and countercontact 29 are thereby cleaned, so that the electrical contact resistance is very low.

Figure 6:
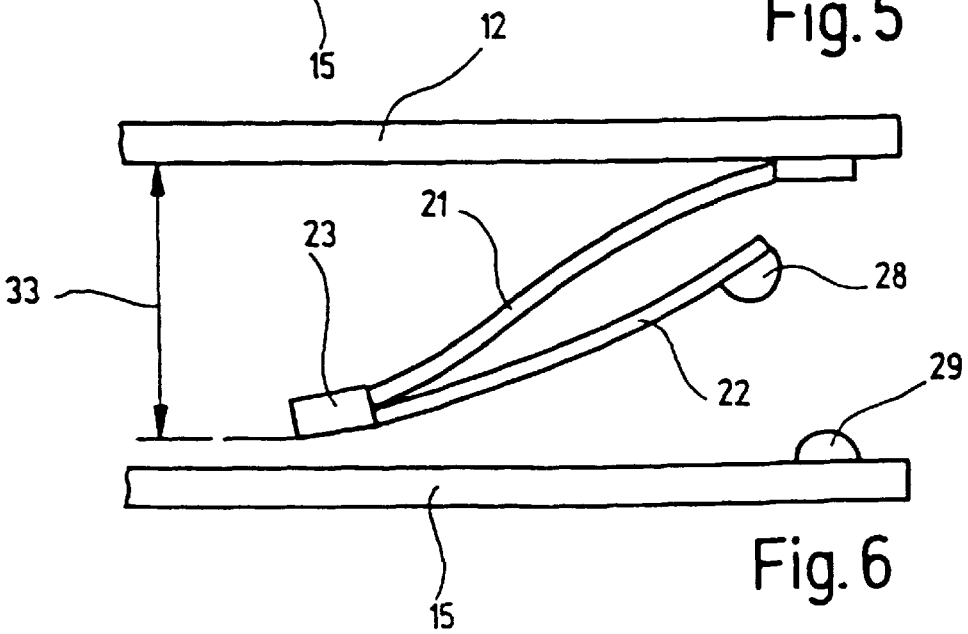
FIG. 6 shows a depiction like that of FIG. 4, although the switching member is in its open position.

If the temperature of switching member 22 then rises further, it snaps over in the direction of arrow 35 into its open position as depicted in FIG. 6. Join 23 moves even farther downward, while switching member 22 has lifted movable contact element 28 away from countercontact 29. A comparison between FIGS. 4 and 6 reveals that join 23 between connection electrodes 12, 15 moves downward, while movable contact element 28 moves upward in the opposite direction, so that the clearance between the two connection electrodes 12, 15 is, so to speak, doubly utilized.

In the position shown in FIG. 6, spring element 21 prevents any contact between join 23 and connection electrode 15. If it should be necessary for elasticity reasons to design the spring element so that it presses join 23 in FIG. 6 onto connection electrode 15, an insulating element can be provided between join 23 and connection electrode 15, as indicated in FIG. 1 at 36. When switching member 22 moves into its open position in FIG. 1, spring element 21 presses join 23 onto insulating element 36, which thus prevents any contact with connection electrode 15.

Therefore, what I claim is:

1. A switch for conducting an electrical current, comprising a first and at least a second external terminal; and a temperature-dependent switching mechanism for making an electrically conductive connection between said two external terminals as a function of the temperature of said switching mechanism, said switching mechanism including a switching member and a spring element permanently connected electrically and mechanically in series with said switching member, said switching member changing its geometrical shape between a closed position and an open position as a function of temperature;

in said closed position of said switching member said current flowing from said first external terminal via said spring element and said switching element to said second external terminal, said spring element having a largely temperature-independent elastic or displacing force, and said switching member having a temperature-dependent elastic or displacing force which in said switching mechanism's creeping phase is greater than said elastic or displacing force of said spring element, such that deformation of the switching member during its creeping phase is compensated for by deformation of the spring element.

2. The switch of claim 1, wherein the switching member comprises a bimetallic element.

3. The switch of claim 1, wherein the switching member comprises a trimetallic element.

4. The switch of claim 1, wherein the spring element is joined at its first end to a first connection electrode that is connected to the first external terminal and at its second end via a joint to the switching member.

5. The switch of claim 4, wherein the switching mechanism is arranged such that the joint is free of any abutment during the creeping phase of the switching member.

6. The switch of claim 4, wherein in its closed position the switching member is pressed with its free end, by the spring element, against a countercontact joined to a second connection electrode that is connected to the second external terminal, and in its open position its free end lifts away from the countercontact.

7. The switch of claim 6, wherein the countercontact is fixed immovable with respect to the switch.

8. The switch of claim 6, wherein the switching member carries at its free end a movable contact element which coacts with the countercontact.

9. The switch of claim 1, wherein the switching member and spring element are welded to one another.

10. The switch of claims 1, wherein the switching member and spring element are joined permanently to one another by crimping.

11. The switch of claim 6, wherein the free end of the switching member and the first end of the spring element lie on the same side of the second end of the switching member.

12. The switch of claim 1, wherein the first external terminal is joined to a connection electrode to which the spring element is attached with its first end.

13. The switch of claim 1, wherein the second external terminal is joined to a second connection electrode and the switching mechanism is arranged between the first and the second connection electrode.

14. The switch of claim 12, wherein the second external terminal is joined to a second connection electrode and the switching mechanism is arranged between the first and the second connection electrode.

15. The switch of claim 14, wherein the second connection electrode is an integral part, by injection-embedding, of an insulating lower housing part which is closed off by the first connection electrode.

16. The switch of claim 12, wherein the switching member, spring element, and both connection electrodes are stamped out from strip material.

17. A switch for conducting an electrical current, comprising a first and at least a second external terminal; and a temperature-dependent switching mechanism for making an electrically conducting connection between said two external terminals as a function of the temperature of said switching mechanism, said switching mechanism including a switching member and a spring element permanently connected electrically and mechanically in series with said switching member, said switching member changing its geometrical shape between a closed position and an open position as a function of temperature;

in said closed position of said switching member said current flowing from said first external terminal via said spring element and said switching element to said second external terminal, said spring element having a largely temperature-independent elastic or displacing force, and said switching member having a temperature-dependent elastic or displacing force which in said switching mechanism's creeping phase is greater than said elastic or displacing force of said spring element, wherein the first external terminal is joined to a connection electrode to which the spring element is attached with its first end, wherein the second external terminal is joined to a second connection electrode and the switching mechanism is arranged between the first and the second connection electrode, and wherein the first and the second connection electrode are held by an insulating support.

* * * * *